US010080477B2

(12) United States Patent
Fauth et al.

(10) Patent No.: US 10,080,477 B2
(45) Date of Patent: Sep. 25, 2018

(54) DISHWASHER WITH DISH DETECTION DEVICE

(75) Inventors: Michael Fauth, Pleinfeld (DE); Helmut Jerg, Giengen (DE); Kai Paintner, Adelsried (DE)

(73) Assignee: BSH Hausgeräte GmbH, Munich (DE)

( * ) Notice: Subject to any disclaimer, the term of this patent is extended or adjusted under 35 U.S.C. 154(b) by 2043 days.

(21) Appl. No.: 13/319,523

(22) PCT Filed: Apr. 29, 2010

(86) PCT No.: PCT/EP2010/055786

§ 371 (c)(1),
(2), (4) Date: Nov. 9, 2011

(87) PCT Pub. No.: WO2010/136294

PCT Pub. Date: Dec. 2, 2010

(65) Prior Publication Data

US 2012/0060875 A1 Mar. 15, 2012

(30) Foreign Application Priority Data

May 29, 2009 (DE) ..... 10 2009 023 252

(51) Int. Cl.
*A47L 15/42* (2006.01)
*A47L 15/46* (2006.01)

(52) U.S. Cl.
CPC ..... *A47L 15/4295* (2013.01); *A47L 15/46* (2013.01); *A47L 2401/04* (2013.01); *A47L 2501/30* (2013.01)

(58) Field of Classification Search
CPC ..... A47L 15/4295; A47L 2401/04
See application file for complete search history.

(56) References Cited

U.S. PATENT DOCUMENTS

2006/0130876 A1* 6/2006 Curtius et al. ..... 134/18
2007/0181162 A1* 8/2007 Classen ..... A47L 15/4295 134/25.2

(Continued)

FOREIGN PATENT DOCUMENTS

DE 10246016 A1 4/2004
EP 0793939 A1 9/1997
EP 1110499 A2 6/2001

(Continued)

OTHER PUBLICATIONS

Machine Translation of EP1192893A2 (Apr. 3, 2002).*

(Continued)

*Primary Examiner* — Spencer E Bell
(74) *Attorney, Agent, or Firm* — Michael E. Tschupp; Andre Pallapies; Brandon G. Braun

(57) ABSTRACT

A dishwasher, in particular a household dishwasher, having a wash tub for receiving dishes during a wash cycle, having a dish reception device for receiving the dishes put into the wash tub, and a control device for controlling the course of the wash cycle depending on the received dishes. Thereby, it is provided that the dish reception device has a plurality of evaluation modules, which are designed each for receiving a dish type consisting of a similar material by means of the signals of at least one sensor and/or by means of at least one control parameter of the control device.

25 Claims, 2 Drawing Sheets

(56) References Cited

U.S. PATENT DOCUMENTS

| | | | |
|---|---|---|---|
| 2010/0294311 | A1 | 11/2010 | Classen et al. |
| 2011/0017235 | A1 | 1/2011 | Berner et al. |

FOREIGN PATENT DOCUMENTS

| | | | | | |
|---|---|---|---|---|---|
| EP | 1192893 | A2 * | 4/2002 | | |
| EP | 0943287 | B1 | 1/2004 | | |
| WO | WO 2009114346 | A1 * | 9/2009 | ..... | A47L 15/42 |
| WO | WO 2009126482 | A1 * | 10/2009 | | |

OTHER PUBLICATIONS

Machine Translation of EP0943287A1 (Sep. 22, 1999).*
Machine Translation of DE10246016A1 (Apr. 15, 2004).*
Machine Translation of EP1110499A2 (Jun. 27, 2001).*
International Search Report PCT/EP2010/055786.

* cited by examiner

DISHWASHER WITH DISH DETECTION DEVICE

BACKGROUND OF THE INVENTION

The present invention relates to a dishwasher, in particular a household dishwasher, having a wash tub for receiving dishes during a wash program, having a dish detection device for detecting the dishes put into the wash tub, and a control device for controlling the sequence of the wash program depending on the detected dishes.

Current household dishwashers include a plurality of components, such as for instance pumps, heating devices, valves, water switches and dosing devices for detergents and cleaning aids, which interact to enable the cleaning of dishes put into the wash tub. To ensure this interaction, dishwashers comprise an electric or an electronic control device, which automatically controls the components of the dishwasher according to a wash program designed in advance. The design of the wash program has in this way a decisive influence on the efficiency of the dishwasher, which results from an offsetting on the one hand of the achieved cleaning and drying effect and on the other hand of the required usage of energy, water and detergents and cleaning aids.

Conventional control devices are embodied here such that the sequence of a wash program is fixedly predetermined. This means that the wash program, once it has been started by an operator, always proceeds in the same way. In order now to allow for the situation whereby in practice the dishwasher can be loaded differently from wash cycle to wash cycle, it has been usual for a long time to store different wash programs in the control device. A short program can therefore be provided for instance for only lightly soiled dishes, a normal program for normally soiled dishes and an intensive program for heavily soiled dishes. Here the selection of the suitable program is left to the operator. However, after one of the available wash programs is selected, the wash cycle is implemented according to the pattern which is predetermined by the selected wash program.

In contrast it has more recently been suggested that dishwashers should be provided with a dish detection device and the control device should be embodied such that the sequence of the selected wash program is automatically adjusted to the dishes detected by the dish detection device.

Known dish detection devices can be divided into two groups. A first group enables an estimation of the total quantity of dishes put into the wash tub. To this end sensors are used which may operate according to different physical principles. For instance it is known to provide sensors for determining the weight of the dishes directly in or on the wash tub in order to detect the total quantity of dishes.

A second known group of dish detection devices is provided to determine the type of dish elements to be washed. It has been proposed for instance to detect the contours of the dish elements by means of a light barrier when loading the dishwasher to distinguish plates from pots for instance.

The adjustment of the sequence of a wash program to the total quantity of dishes put into the wash tub and/or to the type of dish elements put in at best enables a gradual improvement in the efficiency of the dishwasher by comparison with older dishwashers. However the water and energy consumption and the detergent and cleaning aid usage, which is needed for an at least satisfactory cleaning of the item being washed, are far higher than currently required values.

BRIEF SUMMARY OF THE INVENTION

The object of the present invention is to increase the efficiency of a generic dishwasher.

The object is achieved in a dishwasher of the type cited in the introduction in that the dish detection device comprises a plurality of evaluation modules, which are embodied in each instance to detect a type of dish consisting of the same type of material based on the signals of at least one sensor and/or based on at least one control parameter of the control device (18).

An evaluation module is understood here to mean part of the dish detection device, which is embodied to evaluate the signals of at least one sensor, with the evaluation allowing for at least one qualitative statement as to whether a type of dish consisting of a certain material is present in the wash tub. An evaluation module of this type preferably also allows a quantitative statement relating to the quantity of the respective dish type. Each evaluation module directly evaluates the signals of one or several sensors according to a predefined algorithm, to precisely detect a type of dish. The respective algorithm is embodied here to identify features of the signals of a sensor, which are specific to a certain type of dish. The evaluation modules here operate independently of one another, so that the evaluation of the signals relating to one type of dish takes place independently of the evaluation of the signals relating to another type of dish. An evaluation module therefore directly detects the presence of a certain type of dish and not only the relationship of the proportions of two different types of dish. Particularly accurate detection of the different types of dish is thus possible.

The dish detection device and its evaluation modules are connected to the control device of the dishwasher such that the information determined by the evaluation modules can be used by the control device.

At least one control parameter of the control device can optionally also be used to detect a type of dish consisting of the same type of material by means of the dish detection device in addition to or independently of the signals of the respective sensor. Such a control parameter may be for instance an electric current drawn by the circulation pump as a function of a load acting thereon. In general terms, an index or identification measure can therefore be determined directly and/or indirectly for the respectively present type of dish by means of at least one dish detection device.

In particular the dish detection device can be provided as an independent assembly. Alternatively it may also be partially or wholly a component part of the control device.

With the inventive dishwasher, an adjustment of the sequence of a selected wash program to the material of the dish and/or item to be washed which is put into the wash tub can in particular take place by means of the control device. In this way when controlling the dishwasher it is possible to take into account that typical dish soiling adheres with a different level of persistence to different materials. If the dishes present in the wash tub therefore consist of a material which is comparatively easy to clean, the wash pressure and/or the temperature of the wash water can be reduced for instance during a wash program. Similarly, it is conceivable to shorten the run time of a wash program and/or to reduce the quantity of administered detergent and cleaning aid, whilst still maintaining the necessary cleaning effect. A significant improvement in the efficiency of the dishwasher can be achieved in this way.

A further advantage of the inventive dishwasher in particular is that it is possible to significantly reduce the energy outlay needed for drying the dishes. This is because different materials have a different drying behavior. By means of the inventive detection of the materials present in the wash tub, it is directly possible by means of at least one signal of one or several sensors or indirectly possible by means of one or several control parameters derived in the control device to ensure that only the quantity of energy which is actually necessary is expended in order to dry the dishes.

Furthermore the inventive dishwasher enables in particular an adjustment of the wash program to the resistance of the dishes present in the wash tub in each instance. If temperature-sensitive materials are detected for instance, the wash water temperature can be automatically reduced. A gentle cleaning of the dishes is enabled in this way.

Furthermore a further advantage results in that the number of different wash programs stored in the control device can in many instances be reduced due to the adaptivity of the wash program. This simplifies operation of the dishwasher which is associated with a reduction of the risk of incorrect operation.

According to a preferred development of the invention, one of the evaluation modules is embodied to detect plasticware. Plasticware generally has the property whereby typical dish soiling only adheres relatively loosely. However plasticware dries poorly compared with other types of dish. The detection of plasticware and an adjustment of the sequence of the wash program based on this therefore allow a significant increase in the efficiency of the dishwasher.

According to a further preferred development of the invention, one of the evaluation modules is embodied to detect metalware. Soiling adheres to metalware comparatively well. This is true in particular of metalware, which is heated during conventional usage, such as for instance pots and pans. The detection of metalware and an adjustment of the wash program based on this ensure that dirt is also reliably removed from metalware, with the increased outlay for this only being applied when it is actually needed. A significant increase in the efficiency of the dishwasher results in this way.

According to a further development of the invention, one of the evaluation modules is embodied to detect glassware. Glassware is generally only slightly soiled, with soiling only adhering comparatively loosely. The detection of glassware and the subsequent adjustment of the sequence of the wash program therefore enable a further increase in the efficiency of the dishwasher. By adjusting the wash program to a load in the wash tub which includes glassware, damage to the relatively sensitive glassware can also be prevented. In particular the washing out of ions from the glassware, which is also known as "glass corrosion", can be prevented by adjusting the wash parameters.

If the dish detection device includes several of the cited evaluation modules, a combinatory effect results, which enables a particularly accurate adjustment of the wash program to the load in the wash tub. If the dish detection device includes an evaluation module for detecting plasticware, an evaluation module for detecting metalware and an evaluation module for detecting glassware, the mixed loads which occur during practical use of a dishwasher can be detected in respect of their relevant main types of dish. This enables optimum adjustment of the wash program to a majority of the load compositions which occur during practical operation. The wash parameters can then be adjusted specifically to the respectively present mixed load.

An increase in the temperature of the wash water provided in order to wash metalware therefore does not take place for instance if glassware, which could be damaged by the increased temperature, is also present in the mixed load. In order to be able to clean the metalware satisfactorily still, the duration of the wash program can be lengthened.

If the mixed load also includes plasticware, the drying segment of the wash program can be adjusted to this, even if this would not actually be necessary for metalware and glassware. Overall the use of the cited evaluation modules enables an adjustment of the wash program also to be optimized for mixed loads. An outstanding increase in the efficiency of the dishwasher thus results.

According to an advantageous development of the dishwasher, the dish detection device includes an evaluation module for the (preferably quantitative) detection of the total quantity of dishes present in the wash tub based on the signals of at least one sensor. An evaluation module for detecting the total quantity on the one hand enables a plausibility check of the evaluation module which is specific to the type of dish and on the other hand a differentiation between the total quantity and the quantities of individually detected types of dish allows the quantity of the types of dish which were not detected individually to be determined This enables a particularly good adjustment of the wash program to the load composition actually present and thus a particularly high increase in the efficiency of the dishwasher.

According to a particularly preferred development of the invention, the dish detection device comprises at least one sound transducer for detecting a noise, which is produced as a result of wash water sprayed onto the dishes. The sound transducer is preferably connected to at least one of the evaluation modules. The respective evaluation module is embodied to analyze the noise in particular such that the respective type of dish and/or all dishes can be detected according to a predetermined noise evaluation algorithm. The jets of spray water striking the dishes during operation of the dishwasher generate noises, the properties of which depend inter alia on the material of which the dishes consist. These noises are converted to a signal using a sound transducer, for instance to an electric signal, and are fed to an evaluation module. The evaluation module then analyses this signal for features which are characteristic of a certain material. A dish detection device embodied in this way allows the detection of individual types of dish with high accuracy, since different types of dish produce clearly identifiable noise patterns.

According to a preferred development of the invention, provision is made for a spray arm which rotates during the wash program to spray the dishes with wash water, with the evaluation module connected in each instance to the sound transducer being embodied to analyze the noise over at least one rotation of the spray arm. This ensures that the entire wash tub is examined in respect of the occurrence of a certain type of dish.

According to a particularly preferred development of the invention, the evaluation module connected to the sound transducer is embodied to analyze the noise over a plurality of rotations of the spray arm. An accumulation of the signal over a plurality of rotations of the spray arm increases the accuracy of detection by improving the signal interference ratio. In particular a negative influence of background noises can be significantly reduced.

According to an advantageous development of the invention, the evaluation module which is connected in each instance to the sound transducer is embodied to analyze the frequencies contained in the noise. Compared with evaluation modules which only analyze the intensity of the sound, a significantly more accurate distinction results in respect of the different types of dish.

According to a particularly preferred development of the invention, the evaluation module for detecting plasticware and/or the evaluation module for detecting metalware is connected to the sound transducer. Plasticware and metalware specifically generate characteristic noises and/or noise components. The sound transducer is therefore particularly well suited to detecting plasticware and/or metalware.

According to an expedient development of the invention, the sound transducer is arranged in the region of a lower rack. Conventional dishwashers comprise a lower and an upper rack. Here plasticware, for instance mixing bowls made of plastic, and metalware, for instance pots and pans, are predominantly arranged in the lower rack. Plasticware and metalware can therefore be particularly easily detected, if the sound transducer is arranged in the region of this lower rack.

According to a particularly preferred development of the invention, the dish detection device comprises at least one light source for illuminating the dishes and at least one camera for the pictorial capturing of light reflexes occurring at the dishes, with the respective camera being connected to at least one of the evaluation modules, with the respective evaluation module for analyzing the light reflexes being embodied such that the respective type of dish and/or all dishes can be detected according to a predetermined light evaluation algorithm. Here the light source may include light-emitting diodes or incandescent lamps for instance. The camera can be an electronic camera, for instance a C-MOS camera. The camera can be equipped with a wide-angled lens to ensure as large a detection region as possible.

The detection of a type of dish using a dish detection device of this type is based on characteristic light reflexes occurring at the surfaces of different materials. Light reflexes, also known as highlights or highlight areas, are locally limited reflections of light which are characterized in that they are considerably lighter than the background. The light reflexes generated by the respective light source and captured by the respective camera are analyzed by means of a suitable light evaluation algorithm, with a specific type of dish or the total quantity of dishes being detected based on the properties of the light reflexes. The advantage of a dish detection device which is structured in this way is that detection can be implemented even before the actual wash program.

According to an expedient development of the invention, the evaluation module which is connected in each instance to the camera is embodied to determine the number and/or size of the light reflexes generated on the dishes. Such an evaluation of the light reflexes can be implemented with a comparatively simple light evaluation algorithm.

According to a preferred development of the invention, the evaluation module which is connected in each instance to the camera is embodied to determine the ratio of the brightness of the light reflexes to the brightness of their immediate background. This brightness ratio is characteristic of many materials so that certain types of dish can be distinguished with great reliability.

According to an advantageous development of the invention, the evaluation module which is connected in each instance to the camera is embodied to determine the brightness distribution within the light reflexes. The distinction between different types of dish is further improved by means of the alternative or additional determination of the brightness distribution within the light reflexes.

According to an expedient development of the invention, the camera is connected to the evaluation module in order to detect glassware. Particularly contrast-rich light reflexes are produced specifically on glass surfaces. Glassware can thus be detected particularly well by means of an evaluation of the images supplied by the camera.

According to a preferred development of the invention, the camera is arranged in the region of an upper rack of the dishwasher. Glassware is predominantly put into an upper rack of a dishwasher, so that a camera arranged in this way can easily detect the essential glass element of a wash load.

According to an advantageous development of the invention, the evaluation module for detecting the total quantity of the dishes is connected to at least one sensor for detecting the quantity of wash water adhering to the dishes. This is based on the consideration that the total quantity of dishes present in the wash tub corresponds to the total quantity of wash water adhering to the dishes during a wash cycle. The quantity of adhering wash water is essentially independent of the material of the dishes and can be detected with relatively simple sensors.

According to an expedient development of the invention, the sensor for detecting the quantity of wash water adhering to the dishes is embodied as a sensor for monitoring the rotational speed of a circulation pump. With current dishwashers, a defined quantity of water is introduced into the wash tub at the start of a segment of a wash program. This collects in a lower region of the wash tub due to gravity, for instance in a sump provided for this purpose. In order now to circulate the wash water in the wash tub, a circulation pump is provided for instance which extracts the wash water from the sump and sprays it into the wash tub via a spray device. The wash water strikes the dishes to be washed, with some of the wash water adhering to the dishes and some flowing back into the sump. If the quantity flowing back is however so small that the circulation pump takes in air as well as water, the rotational speed of said pump changes. It is possible to conclude the total quantity of dishes present in the wash tub from the occurrence of this effect. The monitoring of the rotational speed of the circulation pump can take place for instance by monitoring the electrical operating data of the pump, such as for instance power consumption, with the aid of the control device, or by monitoring the noises of the circulation pump, in particular based on at least one control parameter of the control device. The profile of the electrical current taken up by the circulation pump can be used for instance by the control device as a measure of the rotational speed of the circulation pump. At least one criterion relating to the type of dish to be washed can therefore be indirectly derived by means of the control device. By monitoring the rotational speed of the circulation pump, it is also possible to prevent the dishwasher from being operated with a faulty water supply. The corresponding sensor is therefore used for several tasks.

According to an advantageous development of the invention, the sensor for detecting the quantity of wash water adhering to the dishes is embodied as a sensor for monitoring a level of the wash water collecting in a lower region of the wash tub. A sensor of this type is designed simply but provides sufficiently accurate measuring results.

According to an expedient development of the invention, the evaluation module for detecting the total quantity of dishes is connected to a sensor for detecting the heating rate. The heating rate indicates the value by which the temperature of the wash water increases due to the effect of a heating device of the dishwasher over a specific time. The heating rate is lower, the more dishes there are in the wash tub. The actual measuring sensor can be a simple temperature sensor, which is needed anyway to control the temperature of the wash water. The heating rate can therefore be determined without any major structural changes to the dishwasher.

According to an expedient development of the invention, the evaluation module for detecting the total quantity of dishes is connected to a sensor for detecting the weight of the dishes. The sensor can be embodied such that the total weight of the wash tub or the total weight of the racks is detected. The sensor can to this end include one or several so-called strain gauges. A simple and comparatively accurate detection of the total quantity of dishes results.

According to a particularly preferred development of the invention, the dish detection device comprises a digital signal processor for evaluating a signal of one of the sensors. Digital signal processors are particularly suited to evaluating the signals of the afore-described sound transducer or the signals of the afore-described camera. The evaluation modules assigned to the sensors in each instance are then software modules, which are embodied by the digital signal processor. Digital signal processors here allow the implementation of even complex evaluation algorithms in almost real-time. The evaluation modules realized with the aid of a digital signal processor can be easily implemented and also subsequently adjusted. The dish detection device can comprise several digital signal processors but current performance means that a single digital signal processor is sufficient in many instances.

Within the scope of the invention at least one control parameter of the control device can be used instead of or in addition to the one or several signals of at least one sensor if necessary to detect a type of dish made of the same type of material.

BRIEF DESCRIPTION OF THE DRAWINGS

The invention and its development are explained in more detail below based on the figures, in which.

DETAILED DESCRIPTION OF EXEMPLARY EMBODIMENTS OF THE PRESENT INVENTION

Figure 1:
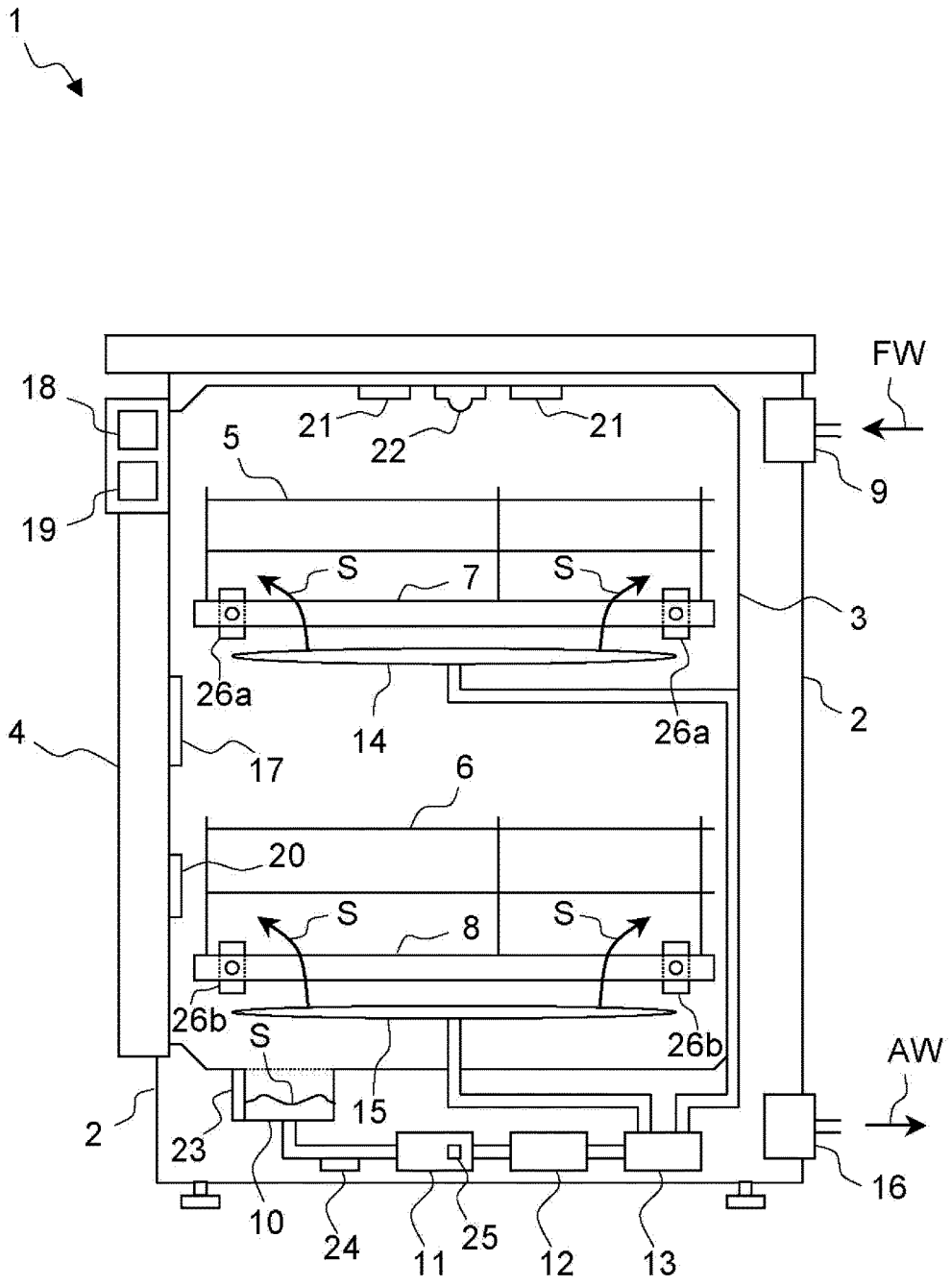
FIG. 1 shows an advantageous exemplary embodiment of an inventively embodied dishwasher in a schematic side view.
Figure 2:
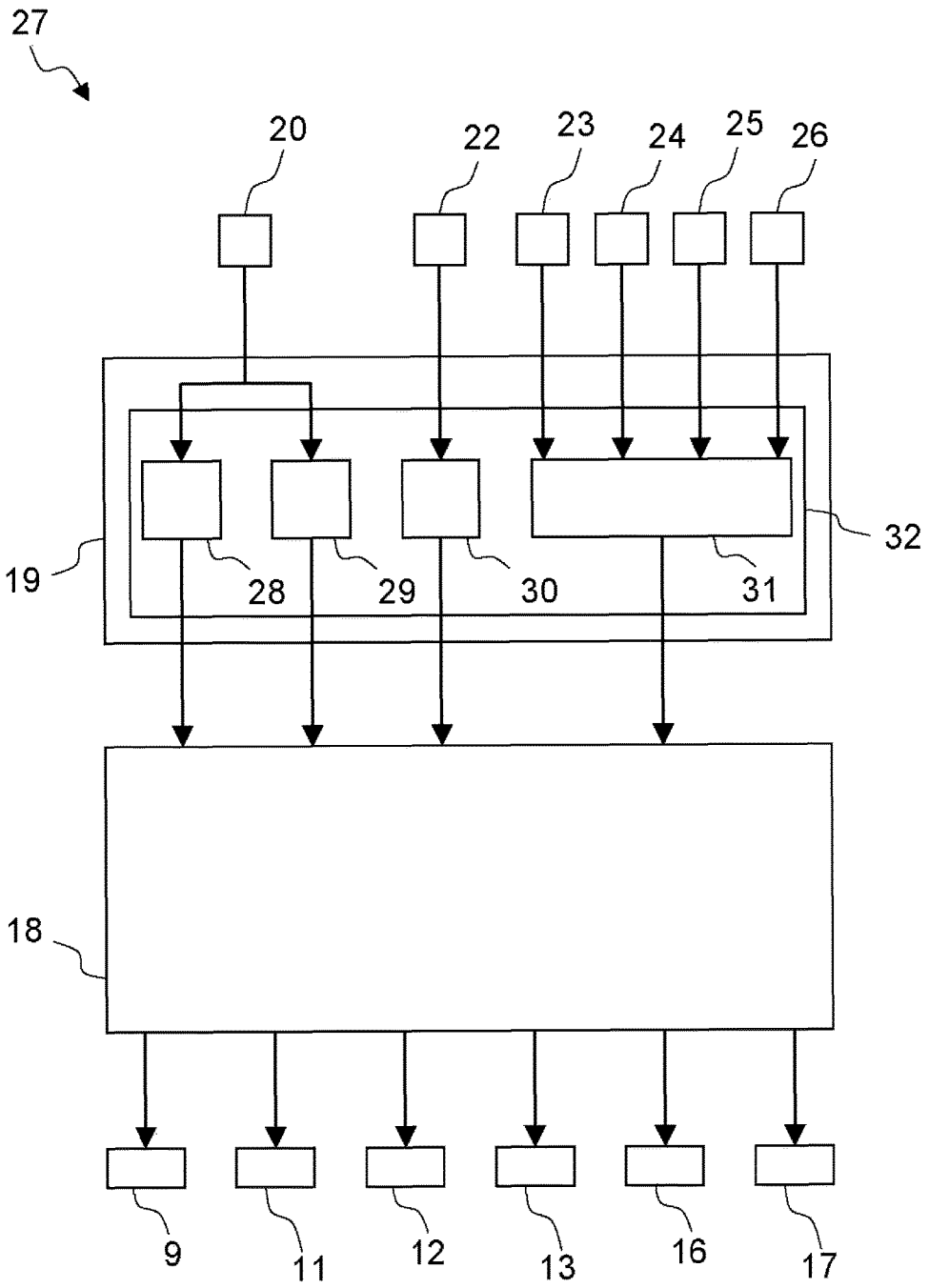
FIG. 2 shows a block diagram of the dish detection device of the dishwasher in FIG. 1.

Elements of identical function and mode of operation are provided with the same reference characters in FIGS. 1 and 2 respectively.

FIG. 1 shows an advantageous exemplary embodiment of an inventively constructed dishwasher 1 in a schematic side view, with only the component parts which are essential for the understanding of the invention being shown and provided with reference characters. The dishwasher 1, which is embodied as a household dishwasher 1, comprises a housing 2, in which a wash tub 3 is arranged. The wash tub 3 can be closed by a door 4, so that a closed washing chamber results for washing dishes. FIG. 1 shows the door 4 in its closed position. The door 4 can be brought into an open position by pivoting about an axis which is arranged at right angles to the plane of the drawing, in which open position it is essentially aligned horizontally and allows the introduction and/or removal of dishes. The dishwasher 1 comprises an upper rack 5 and a lower rack 6 in order to position dishes. The upper rack 5 is arranged here on extension rails 7, which are fastened in each instance to a side wall of the wash tub 3. The rack 5 can be moved out of the wash tub 3 by means of the extension rails 7 when the door 4 is open, which facilitates the loading and/or unloading of the upper rack 5. The lower rack 6 is similarly arranged on extension rails 8.

The dishwasher 1 includes a feed device 9 for fresh water FW, which is embodied such that fresh water FW supplied from the outside can reach the inside of the wash tub 3 in a controlled fashion. The fresh water FW which is supplied in a controlled fashion collects as wash water S in a sump 10 due to gravity, said sump 10 forming a lower part of the wash tub 3. The sump 10 is connected here to a circulation pump 11, with the aid of which wash water S can be pumped out of the sump 10 via a heater 12 to a water switch 13. The water switch 13 comprises two exits, one of which is connected to an upper spray arm 14 and the other of which is connected to a lower spray arm 15. The water switch 13 can be controlled here such that the wash water S conveyed by the circulation pump 11 is optionally conveyed through one of the spray arms 14, 15 or through both spray arms 14, 15 into the wash tub 3, to wash the dishes located there. In order to be able to discharge wash water S which is no longer needed out of the wash tub 3, a discharge device 16 is also provided, which is embodied to convey wash water S to the outside as waste water AW. In order to provide the wash water S with detergents and/or cleaning aids such as rinse aid for instance, a dosing device 17 is also provided.

The dishwasher 1 comprises a control device 18 arranged in the region of a control panel of the door 4, which, for control purposes, is connected to the supply device 9, to the circulation pump 11, to the heater 12, to the water switch 13, to the discharge device 16 and the dosing device 17. The control device 18 is embodied here for the automatic sequence control of a wash program.

A typical wash program here includes several segments which run one after the other. The basic sequence of a wash program is explained by way of example below: a first segment of a wash program is usually provided as a prewash cycle. Here a specific quantity of fresh water FW is routed into the wash tub 3 by way of the supply device 9. The supplied fresh water FW is then circulated for a specific period of time as wash water S in the wash tub 3 by means of the circulation pump 11. The wash water S is usually circulated here in particular at a relatively low temperature of 30° C. degrees for instance. Naturally a more intensive heating of the wash water is also possible during the prewash cycle if necessary. There is no need to add detergents at this point. In the prewash cycle coarser soiling is removed from the dishes to be washed, with the wash water S and soiling being discharged to the outside at the end of the prewash cycle by way of the discharge device 16.

One or several cleaning cycles follow the prewash cycle, wherein the wash tub is filled once again with fresh water FW in each instance. The fresh water FW is brought here as wash water S to a higher temperature, for instance to 50° C., and detergent is added. After circulating the wash water S for a specific period of time, the wash water S is discharged again via the discharge device 16.

In a subsequent final rinse cycle with newly supplied fresh water FW, the wash water S is mixed with rinse aid and circulated. The final rinse cycle prepares for spot-free drying of the washed dishes. To this end, the wash water S is heated to a particularly high temperature, for instance to 70° C., so that the dishes also heat up. At the end of the final rinse cycle, the wash water S is pumped out again.

During the drying cycle that now starts the water adhering to the dishes evaporates on account of the high temperature of the dishes, with the steam condensing on the cold walls of the wash tub 3. This condensed water collects in the sump 10 and can be pumped off. The wash program is thus terminated.

In order now to optimize the sequence of the wash program with a specific loading state of the wash tub 3 in mind, the inventive dishwasher 1 comprises a dish detection device. The adjustment of the sequence can relate here to all the parameters of the basic sequence outlined above.

The dish detection device includes a central unit 19, which is connected to the control device 18 for the exchange of information. The central unit 19 can be arranged in spatial proximity to the control device 18 or can be directly integrated therein.

The dish detection device also includes a plurality of sensors, the sensor signals of which are fed to the central unit 19. The dish detection device therefore includes a sound transducer 20, which is arranged in the region of the lower rack 6 on the inside of the door 4. The sound transducer 20 could however also be arranged on a fixed wall of the wash tub 3. The sound transducer 20 is embodied as a microphone 20 and detects noises which result from wash water S being sprayed onto the dishes in the wash tub 3. Since the noises produced by the striking wash water S essentially depend on the material mix of the dishes, an analysis of the signals generated by the sound transducer 20 enables the detection of one or several types of dish characterized by a mutual material in each instance.

A light source 21 is arranged on the ceiling of the wash tub 3, consisting of two light-emitting diode arrangements 21. The light-emitting diode banks 21 are arranged such that the dishes present in the wash tub 3 are illuminated. Light reflexes, which have different properties depending on the type of dish, are produced at the dish. A camera 22, which is likewise arranged on the ceiling of the wash tub 3, captures the dishes and the light reflexes produced on them. An evaluation of the images of the camera 22 enables a distinction to be made between different types of dish by examining the light reflexes contained therein and a therefore a separate detection thereof.

Independently operating sensors 23, 24, 25, 26 are provided in order to determine the total quantity of dishes present in the wash tub 3. Basically one of said sensors would be sufficient to detect the total quantity of dishes but for a high level of process reliability however a combination of said sensors is meaningful. The sensor 23 is a level sensor 23, which detects the fill level of wash water S in the sump 10. If the quantity of wash water supplied as fresh water FW is known, then the fill level in the sump 10 is a measure of how much water adheres to the dishes during the wash cycle. This adhering quantity of wash water S is in turn a measure of the total quantity of dishes in the wash tub 3.

The sensor 24 is embodied as a temperature sensor 24, which detects the temperature of the wash water S. It enables the heating rate to be determined, in other words an increase in the temperature in a specific time unit, which is effected by the heater 12. The heating rate here is inversely proportional to the total quantity of dishes.

Furthermore the sensor 25 is embodied as a rotational speed sensor 25, with the rotational speed sensor 25 detecting the rotational speed of the circulation pump 11. The determination of the total quantity of dishes can now take place such that a specific quantity of fresh water FW is firstly introduced into the wash tub 3, this is circulated and a check is then made to determine whether the fill level in the sump 10 drops to such a degree that the circulation pump 11 takes in air, which becomes noticeable in an increase in the rotational speed. Fresh water FW is then supplied again in a specific quantity and it is determined whether air is taken in again. This procedure is repeated until no more air is taken in, so that the circulation pump runs smoothly again. This enables a determination of the quantity of wash water S adhering to the dishes, which is a measure of the quantity of items being washed. Instead of the rotational speed sensor 25, it may also be sufficient if the control device 18 derives a measure of the rotational speed of the circulation pump from its current consumption data curve, i.e. determines this indirectly. The separate speed sensor can therefore be omitted.

The sensor 26 is embodied as a weight sensor. The weight sensor 26 includes strain gauges 26*a*, which detect the weight of the upper rack 5. Furthermore the sensor 26 includes strain gauges 26*b*, which detect the weight of the lower rack 6. A separate detection of the dishes arranged in the upper rack 5 and of the dishes arranged in the lower rack 6 is thus possible.

FIG. 2 shows a block diagram of the dish detection device 27. The central unit 19 of the dish detection device 27 includes an evaluation module 28 for detecting plasticware, an evaluation module 29 for detecting metalware, an evaluation module 30 for detecting glassware and an evaluation module 31 for detecting the total quantity of dishes. The central unit 19 here includes a digital signal processor 32, on which the evaluation modules 28 to 31 are set up by means of corresponding software. The evaluation modules 28 to 31 execute an algorithm for evaluating sensor signals in each instance. The evaluation modules 28 to 31 are preferably independent of one another here in so far as the evaluation result of the one evaluation module does not depend on the result of another evaluation module. Sensor signals are always processed directly.

The evaluation module 28 for detecting plasticware is specifically embodied to evaluate the signals of the above-described sound transducer 20. The evaluation module 29 for detecting metalware is also embodied to evaluate the signals of the sound transducer 20, with the detection of metalware however being based on the recognition of noises typical of metalware and the detection of plasticware being based on the recognition of noise components which are typical of plasticware. The evaluation modules 28 and 29 are embodied here to analyze the amplitudes of different frequencies of the noise.

The evaluation module 30 for detecting glassware is embodied to evaluate the images captured by the camera 22. The corresponding images are transmitted here as a signal from the camera 22 to the evaluation module 30.

The evaluation module 31 for the total quantity of dishes is also embodied to evaluate the signals of the level sensor 23, of the temperature sensor 24, of the rotational speed sensor 25 and of the weight sensor 26.

The evaluation results of the evaluation module 28 to 31 are transmitted to the control device 18. The control device 19 is thus able to control the sequence of the wash program as a function of the detected dishes. The control device 18 is therefore able to adjust the quantity of fresh water supplied precisely to the respective load by means of corresponding control commands to the supply device 9. The duration of a circulation phase, for instance in a prewash cycle, can also be controlled by corresponding control commands to the circulation pump 11. Similarly the pressure of the wash water can be varied during the circulation process. The wash water temperature can be adjusted to specific requirements by control commands to the heater 12. Furthermore the distribution of wash water S to the upper and/or lower spray arm can be varied by control commands to the water switch 13. Corresponding control commands to the discharge device 16 ensure that waste water is pumped off after the end of a circulation phase. Furthermore the control device 18 is able to vary the supply of detergents or cleaning aids as a function of the specific load present in the wash tub 3 by means of corresponding control commands to the dosing device 17.

Notwithstanding the exemplary embodiment, it is naturally also possible to provide the light source and the camera and/or the sound transducer at any other suitable point in the wash tub, in particular in its interior.

LIST OF REFERENCE CHARACTERS

1 Dishwasher
2 Housing
3 Wash tub
4 Door
5 Upper rack
6 Lower rack
7 Extension rail
8 Extension rail
9 Supply device for fresh water
10 Sump
11 Circulation pump
12 Heater
13 Water switch
14 Upper spray arm
15 Lower spray arm
16 Discharge device for waste water
17 Dosing device
18 Control device
19 Central unit
20 Sound transducer
21 Light source
22 Camera
23 Level sensor
24 Temperature sensor
25 Rotational speed sensor
26 Weight sensor
27 Dish detection device
28 Evaluation module for plasticware
29 Evaluation module for metalware
30 Evaluation module for glassware
31 Evaluation module for total quantity
32 Digital signal processor
AW Waste water
FW Fresh water
S Wash water

The invention claimed is:

1. A household dishwasher comprising:

a wash tub for receiving dishes during a wash program, a dish detection device configured and adapted to detect the dishes placed in the wash tub, the dish detection device comprising a plurality of evaluation modules having at least a first evaluation module and a second evaluation module configured to operate independently of the first evaluation module, each of the first and second evaluation modules being configured to detect a specific type of dish based on a material of the dish, wherein the first and second evaluation modules respectively, are configured to detect materials of dishes that are different from one another, and wherein evaluation of signals by the first evaluation module relating to one dish material takes place independently of evaluation of signals by the second evaluation module relating to another type of dish materials, a control device configured and adapted to control a sequence of the wash program depending on the detected dishes, and wherein at least one of the first and second evaluation modules is configured and adapted to detect dishes made of an identical material based on signals from at least one sensor operatively connected with the respective evaluation module or based on at least one control parameter of the control device, or both.

2. The dishwasher of claim 1, wherein one of the evaluation modules is constructed to detect plasticware.

3. The dishwasher of claim 1, wherein one of the evaluation modules is constructed to detect metalware.

4. The dishwasher of claim 1, wherein one of the evaluation modules is constructed to detect glassware.

5. The dishwasher of claim 1, wherein the dish detection device comprises a digital signal processor configured and adapted to evaluate the signals received from the at least one sensor.

6. The dishwasher of claim 1, the dish detection device further comprising an evaluation module constructed to detect a total quantity of dishes present in the wash tub based on signals from at least one sensor.

7. The dishwasher of claim 6, wherein the at least one sensor is configured to detect a heating rate.

8. The dishwasher of claim 6, wherein the at least one sensor is configured to detect a weight of the dishes.

9. The dishwasher of claim 6, wherein the total quantity of dishes present in the wash tub is detected by the at least one sensor from a quantity of wash water adhering to the dishes.

10. The dishwasher of claim 9, wherein the at least one sensor detecting the quantity of wash water adhering to the dishes is embodied as a sensor for monitoring a rotational speed of a circulation pump.

11. The dishwasher of claim 9, wherein the at least one sensor for detecting the quantity of wash water adhering to the dishes is embodied as a sensor for monitoring a level of the wash water collecting in a lower region of the wash tub.

12. The dishwasher of claim 1, the dish detection device further comprising at least one sound transducer configured and adapted to detect noise produced by wash water sprayed onto a dish.

13. The dishwasher of claim 12, wherein the at least one sound transducer is arranged in a region of a lower rack.

14. The dishwasher of claim 12, wherein the sound transducer is operatively connected to at least one of the evaluation modules.

15. The dishwasher of claim 14, wherein the at least one evaluation module is constructed to analyze frequencies contained in the noise.

16. The dishwasher of claim 14, wherein the first evaluation module is operatively connected to the at least one sound transducer for detecting plasticware and the second evaluation module is operatively connected to the at least one sound transducer for detecting metalware.

17. The dishwasher of claim 14, wherein the at least one evaluation module is configured to analyze the noise based on a predetermined noise evaluation algorithm and to determine the type of a dish or the types all the dishes commensurate with the analyzed noise.

18. The dishwasher of claim 17, further comprising a spray arm which rotates during the wash program and sprays the dishes with wash water, wherein the at least one evaluation module is configured to analyze the noise over at least one rotation of the spray arm.

19. The dishwasher of claim 18, wherein the at least one evaluation module is configured to analyze the noise over a plurality of rotations of the spray arm.

20. The dishwasher of claim 1, wherein the dish detection device comprises at least one light source for illuminating the dishes and at least one camera for the capturing light reflexes from the dishes, wherein the camera is connected to at least one of the plurality of evaluation modules and the at least one evaluation module is constructed to analyze the light reflexes, wherein the specific type of dish is or the specific types of all dishes are detected based on the analyzed light reflexes according to a predetermined light evaluation algorithm.

21. The dishwasher of claim 20, wherein the at least one evaluation module connected to the at least one camera is configured to determine at least one of a number and a size of the light reflexes from the dishes.

22. The dishwasher of claim 20, wherein the at least one evaluation module connected to the at least one camera is configured to determine a ratio of brightness of the light reflexes to brightness of a background.

23. The dishwasher of claim 20, wherein the at least one evaluation module connected to the at least one camera is configured to determine a brightness distribution within the light reflexes.

24. The dishwasher of claim 20, wherein the at least one evaluation module connected to the at least one camera is configured to detect glassware.

25. The dishwasher of claim 20, wherein the at least one camera is arranged in a region of an upper rack.

* * * * *